US005913444A

United States Patent [19]

Steiner

[11] Patent Number: 5,913,444

[45] Date of Patent: Jun. 22, 1999

[54] TRANSPORT AND/OR STORAGE CONTAINER, PARTICULARLY OF PLASTICS

[75] Inventor: Alfred Steiner, Altmünster, Austria

[73] Assignee: Steiner Freizeitmobel Gesellschaft m.b.H. & Co. KG, Ebensee, Austria

[21] Appl. No.: 08/913,076

[22] PCT Filed: Feb. 26, 1996

[86] PCT No.: PCT/AT96/00028

§ 371 Date: Sep. 5, 1997

§ 102(e) Date: Sep. 5, 1997

[87] PCT Pub. No.: WO96/27530

PCT Pub. Date: Sep. 12, 1996

[30] Foreign Application Priority Data

Mar. 6, 1995 [AT] Austria ..... 123/ 95 U

[51] Int. Cl.[6] ..... B65D 21/032

[52] U.S. Cl. ..... 220/512; 206/427; 206/509; 220/516; 220/519; 220/720; 220/6

[58] Field of Search ..... 220/512, 4.26, 220/6, 509, 510, 511, 516, 519, 529, 720; 206/509, 427, 435

[56] References Cited

U.S. PATENT DOCUMENTS

| | | | |
|---|---|---|---|
| 1,054,035 | 2/1913 | Ruhnau | 220/512 |
| 2,418,248 | 4/1947 | Denton . | |
| 2,459,921 | 1/1949 | Comer | 220/512 |

FOREIGN PATENT DOCUMENTS

| | | | |
|---|---|---|---|
| 231890 | 6/1963 | Austria . | |
| 2507351 | 3/1986 | France . | |
| 12 07 268 | 6/1966 | Germany . | |
| 23 27 854 | 12/1974 | Germany . | |
| 40 20 919 | 1/1992 | Germany . | |
| 295 00 920 | 9/1995 | Germany . | |
| 44 09 965 | 9/1995 | Germany . | |
| 481797 | 1/1970 | Switzerland | 220/512 |
| 1152907 | 5/1969 | United Kingdom . | |
| 93/23301 | 11/1993 | WIPO . | |

*Primary Examiner*—Stephen Castellano
*Attorney, Agent, or Firm*—Alston & Bird LLP

[57] ABSTRACT

The invention relates to a transport and/or storage container (1), particularly of plastics, for transporting goods, such for example as cans, bottles or tubs, with a carrier body (2) which is formed at least by a base (3) which forms a support surface for the transport goods and a plate-shaped positioning device (4) extending parallel to the base (3) provided with apertures (27) for the transport goods, the positioning device (4) being connected by hinge arrangements (5) to the base (3) or with wall members (6) disposed on the base (3) at a spacing (33) from the base (3) and is mounted to be displaceable in a direction vertical to the base (3).

25 Claims, 7 Drawing Sheets

TRANSPORT AND/OR STORAGE CONTAINER, PARTICULARLY OF PLASTICS

Figure 1:
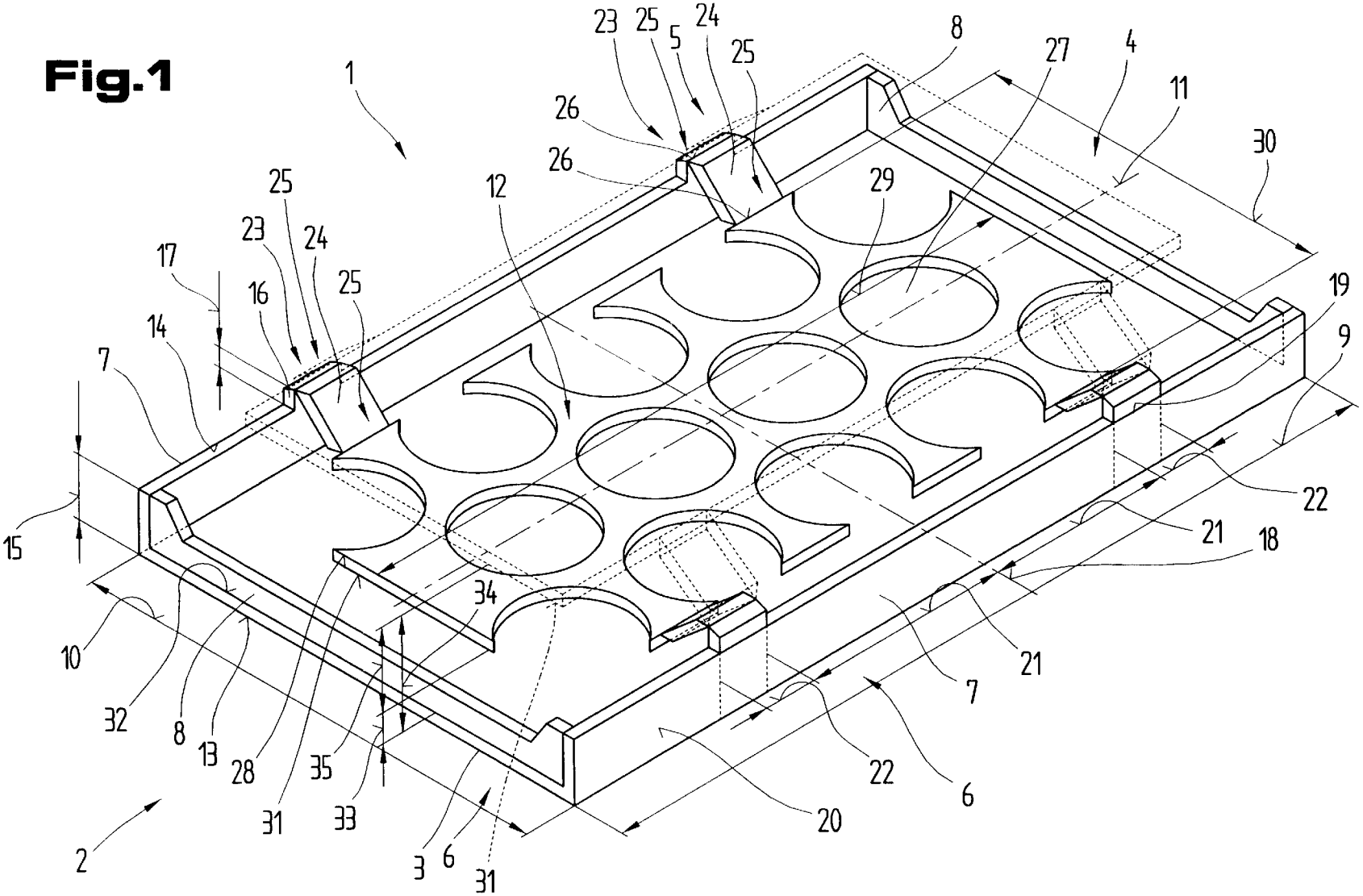

The invention relates to a transport and/or storage container, particularly of plastics, for transported material such for example as tins, bottles or tubs.

Various containers for transporting and storage of transported materials, such as cans, bottles or tubs, made of plastics, are known in which the wall elements are integrally connected to the base and are articulated pivotally to the base via hinge arrangements. The wall members and the bases in these case usually have mouldings, which are adapted to the external contour of the material to be transported. In common with the goods themselves, in this way centring of the same is achieved, and movement of the goods into an undefined intermediate position is prevented. In order however to secure the goods in this way, the container must have a specific minimum height. Particularly in the case of wall members rigidly disposed on the base this requires a constructive height which disadvantageously increases the transport volume in the empty condition.

When wall members are disposed via hinge arrangements on the base, the transport volume in the empty condition is minimised. Thus however complex articulated structures are often necessary, which have a negative influence on the manufacturing costs of such transport containers.

The object underlying the invention is now to provide a transport and/or storage container, which can be simply and cost-effectively manufactured and which, retaining the most effective centring of the transported material, enables a compact construction of the transport container, particularly in the case when transported empty.

The object of the invention is achieved by the features. The surprising advantages of this solution according to the invention reside in the fact that due to the displaceable mounting of the positioning device, this can on the one hand be pivoted into a position close to the base, so that especially when the transport containers are stacked above or in one another, the transport volume, in particular in the empty condition, is minimised, and on the other hand an effective centring of the transported goods is achieved by pivoting the positioning device into a position remote from the base.

An advantageous constructive variant is described, by means of which the individual transport and/or storage containers can be aligned flush with one another and thus the transport volume is optimised.

A design is advantageous, by means of which the connection of the positioning device with the hinge arrangement can be produced simply and thus cost-effectively.

A construction is advantageous, as the hinge arrangement can be connected in a cost-effective and simple way to the base or to the wall members.

A further development is also advantageous, by means of which the positioning device can be disposed in an easily-produced manner on the wall members, or this arrangement simultaneously provides the wall members necessary for stacking the transport containers.

A further advantageous measure is described, by means of which the attachment tabs and thus the entire positioning device is positioned within the transport container. This is particularly important, as the position of the positioning device relative to the transport container or to the transport goods to the transport container is decisive for the most effective utilisation of the available transport volume.

A construction has the advantage that the positioning device can be separated simply from the transport container, so that the transport container and the positioning devices can be individually and compactly stacked and thus stored.

A further development enables the positioning device to be displaced into various vertical positions relative to the transport container in a simple way. A variant is also of advantage, in which the attachment tab and thus the spacer member can be additionally pivoted relative to the positioning device.

A design is however also advantageous, because in this way the hinge arrangements can be cost-effectively and simply manufactured.

A further advantageous measure is described, by means of which an extremely stable hinge arrangement is provided, so that the life duration of such a transport container is increased.

A further development is favourable, by means of which the parts of the transport container forming the hinge are secured against independent loosening.

A construction has the advantage that on the one hand the transport containers can be stacked one above the other in the empty condition in a most compact manner, and on the other hand an interspace remains between the positioning device and the base, so that cleaning of the transport containers may be carried out in a simple way.

Also possible however is a variant, by means of which even higher transport goods such as bottles may be effectively positioned and centred, and thus an undefined intermediate condition during transport is avoided.

Of advantage is a further development, by means of which the transport containers, in a condition filled with transport goods, can be stacked above one another and thus centred, so that slippage of an upper transport container sitting on the wall members or the transport materials is avoided.

A further development is also of advantage, because the transported weight of the transport container is reduced, so that improved loading of transport vehicles can be achieved.

A construction is also possible, according to which stacking of the individual transport containers one above the other is simplified, and at the same time centring in areas of conical transport goods in the transport container is produced.

Furthermore, a construction is possible, by means of which the positioning device is automatically held in the upper transport position by a beyond-dead-centre lock.

A design is also advantageous, by means of which the position of the plate shaped positioning device provided with the apertures can be adjusted in stages. This enables adaptation to the respective storage conditions, in order to simplify removal of the goods or in order to obtain a special display effect.

A design is advantageous, by means of which a technically effective construction of a resilient engagement device is achieved without further additional components.

An advantageous further development is also described, because by means of limiting the degree of pivoting, defined settings are achieved and thus the functional area can be exactly co-ordinated with the order of magnitude of the goods received in the container.

According to an advantageous embodiment as described, a secure stacking combination is achieved, various additional securing devices such for example as packing strips, not being necessary in order to hold the stack together.

A further advantageous design is described, by means of which identification of the containers is easily possible, and this can thus also be used in automated commissioning areas or can be provided with corresponding information, e.g. also in clear text, such as prices, etc.

Finally, advantageous designs are also described. Such designs enable secure retention of the transport material in the transport container, which, in order to minimise the empty volume, is fitted with relatively low side and/or end walls. At a setting of the positioning device in a position above the centre of gravity of the transport material, this material is also well secured and held even during rough transport operation. After storage of such transport containers in transport racks, after lowering the positioning device into a lower position close to the base, the transport material may be easily removed and inconvenient packaging elements are eliminated in display of the goods. These goods frequently have on their side surfaces advertising and/or client information, which is unrestrictedly visible.

Figure 2:
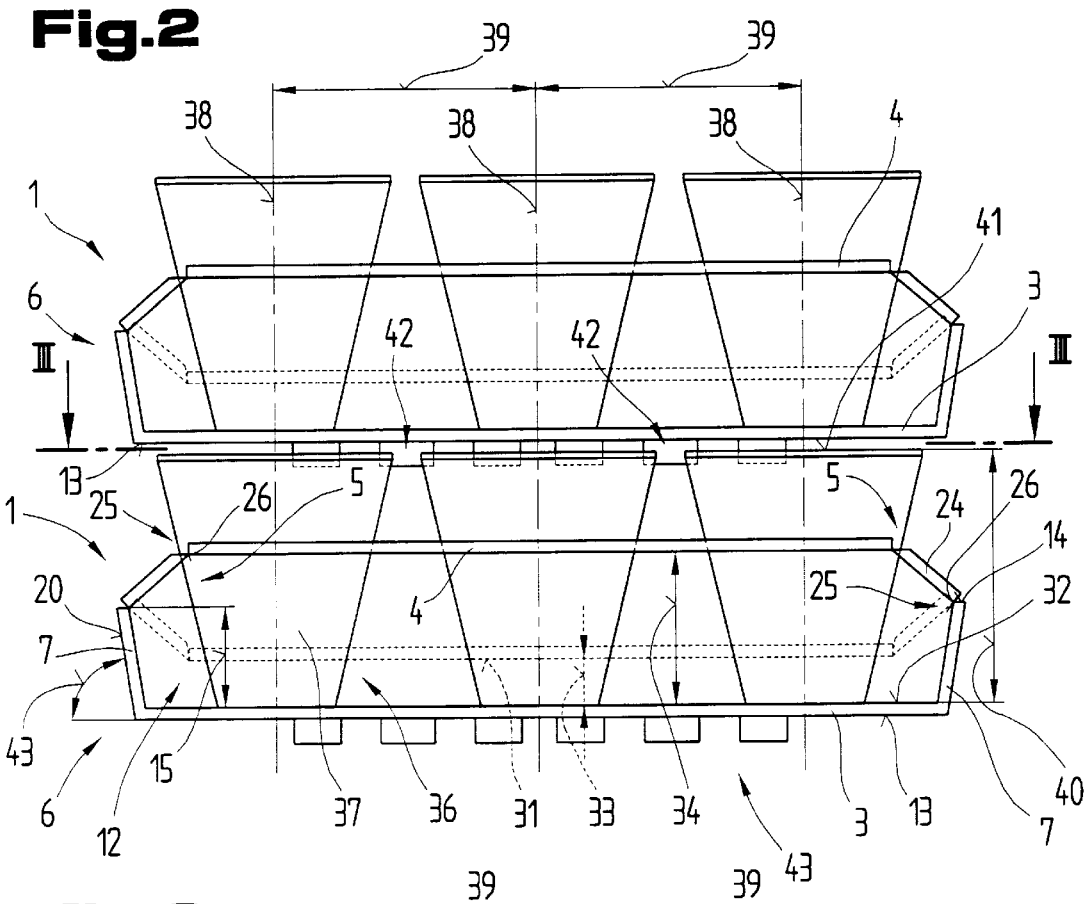
Figure 3:
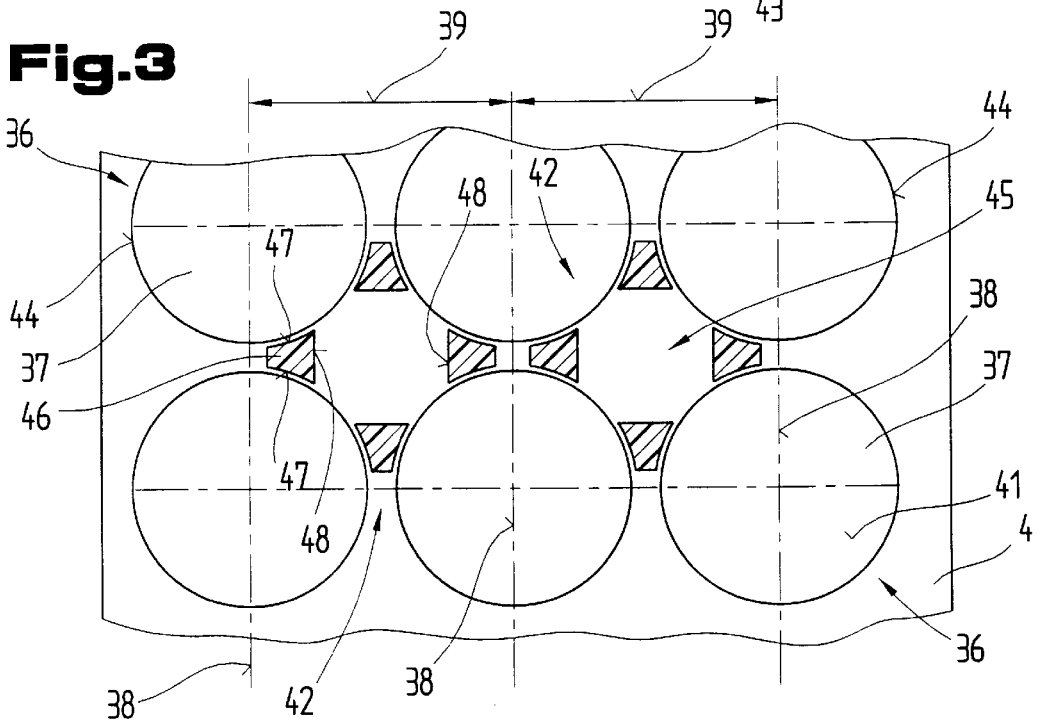
Figure 4:
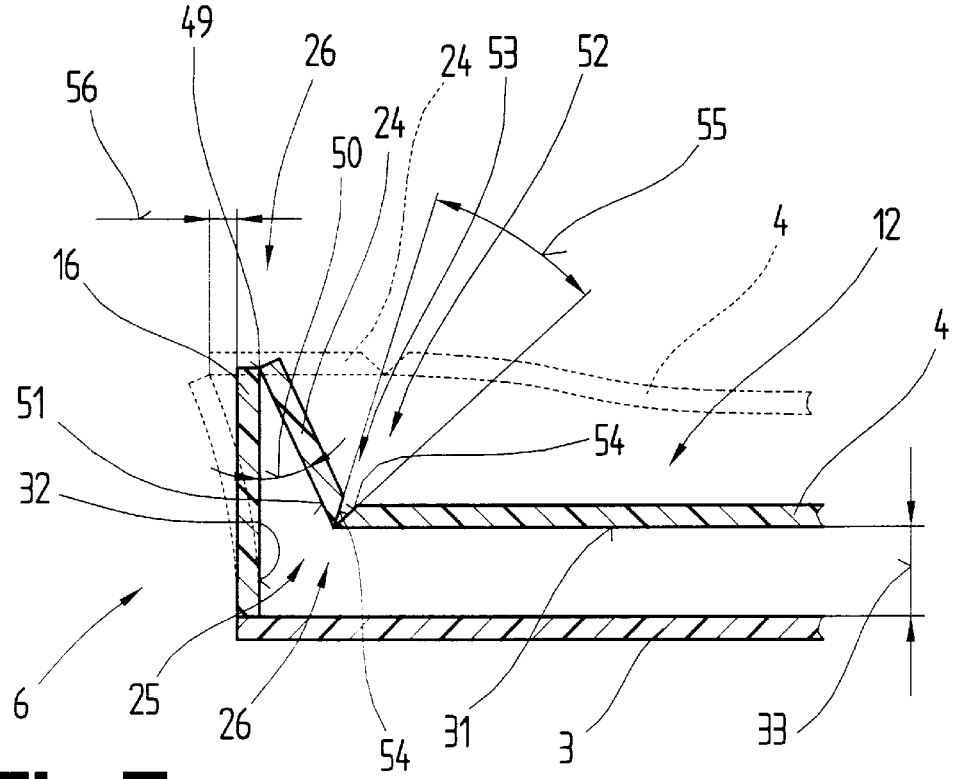
Figure 5:
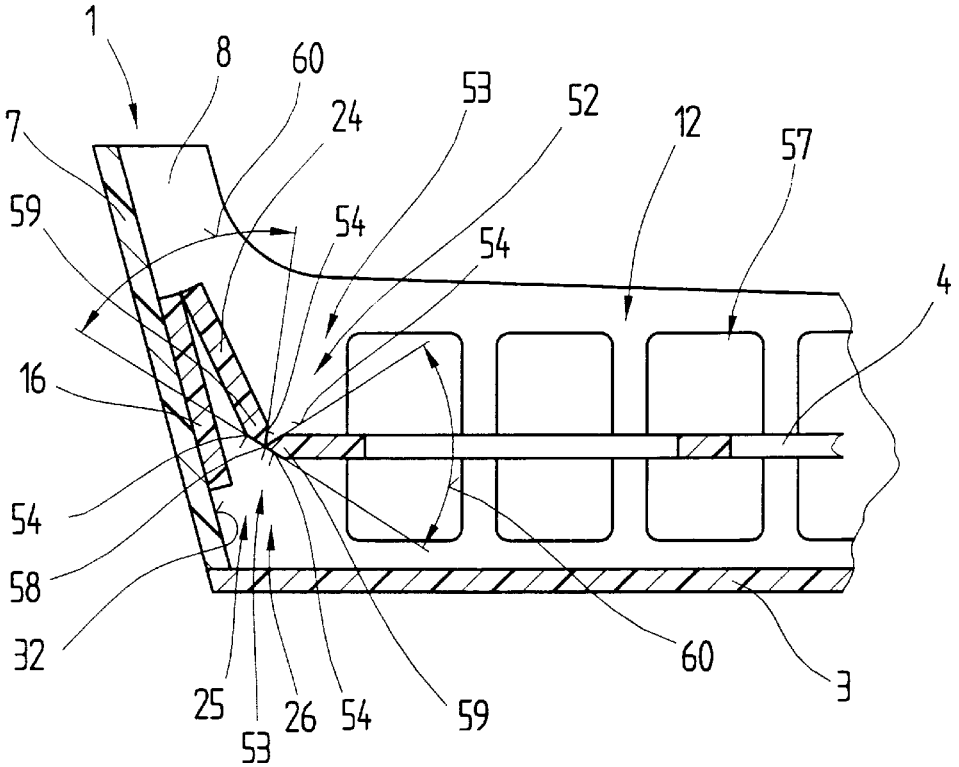
Figure 6:
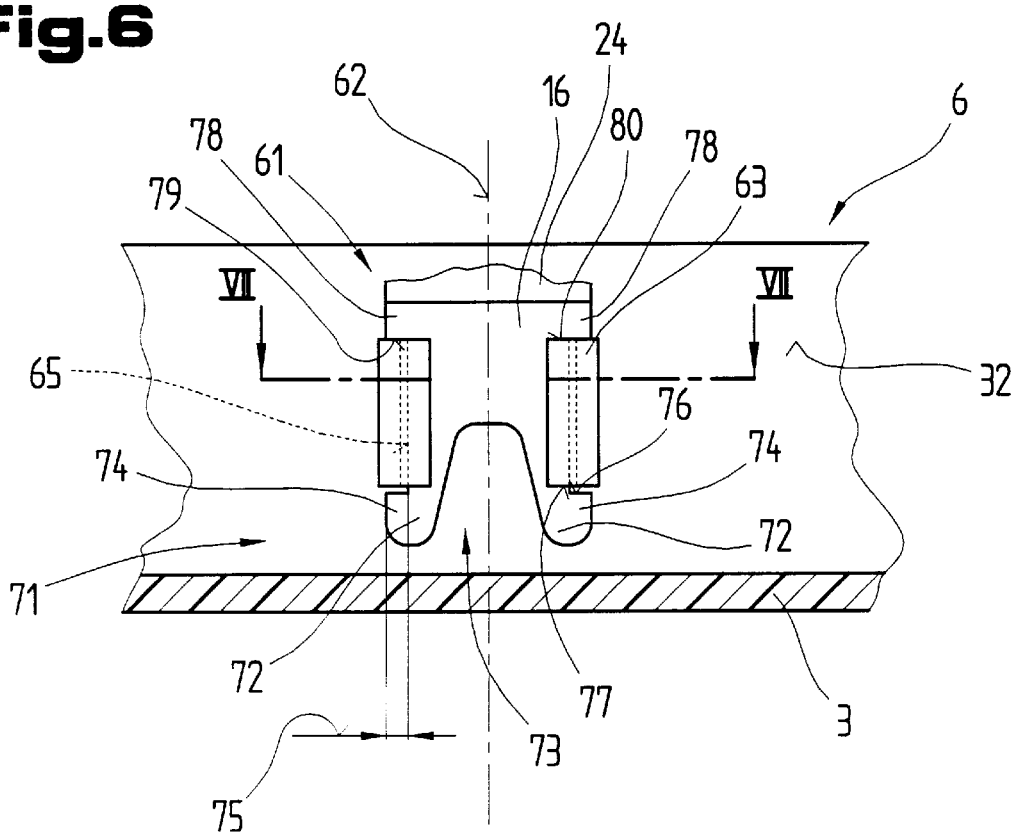
Figure 7:
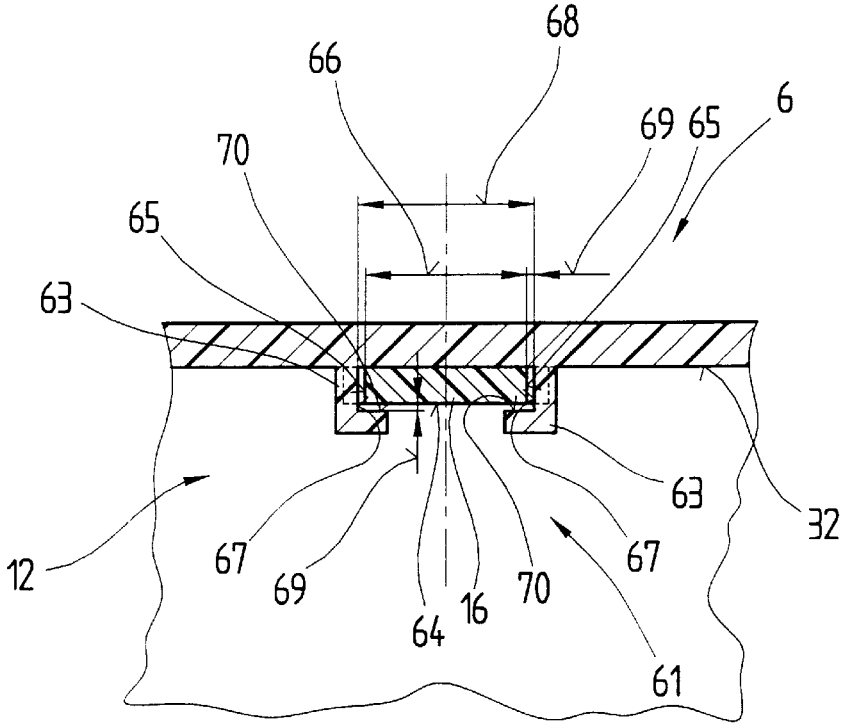
Figure 8:
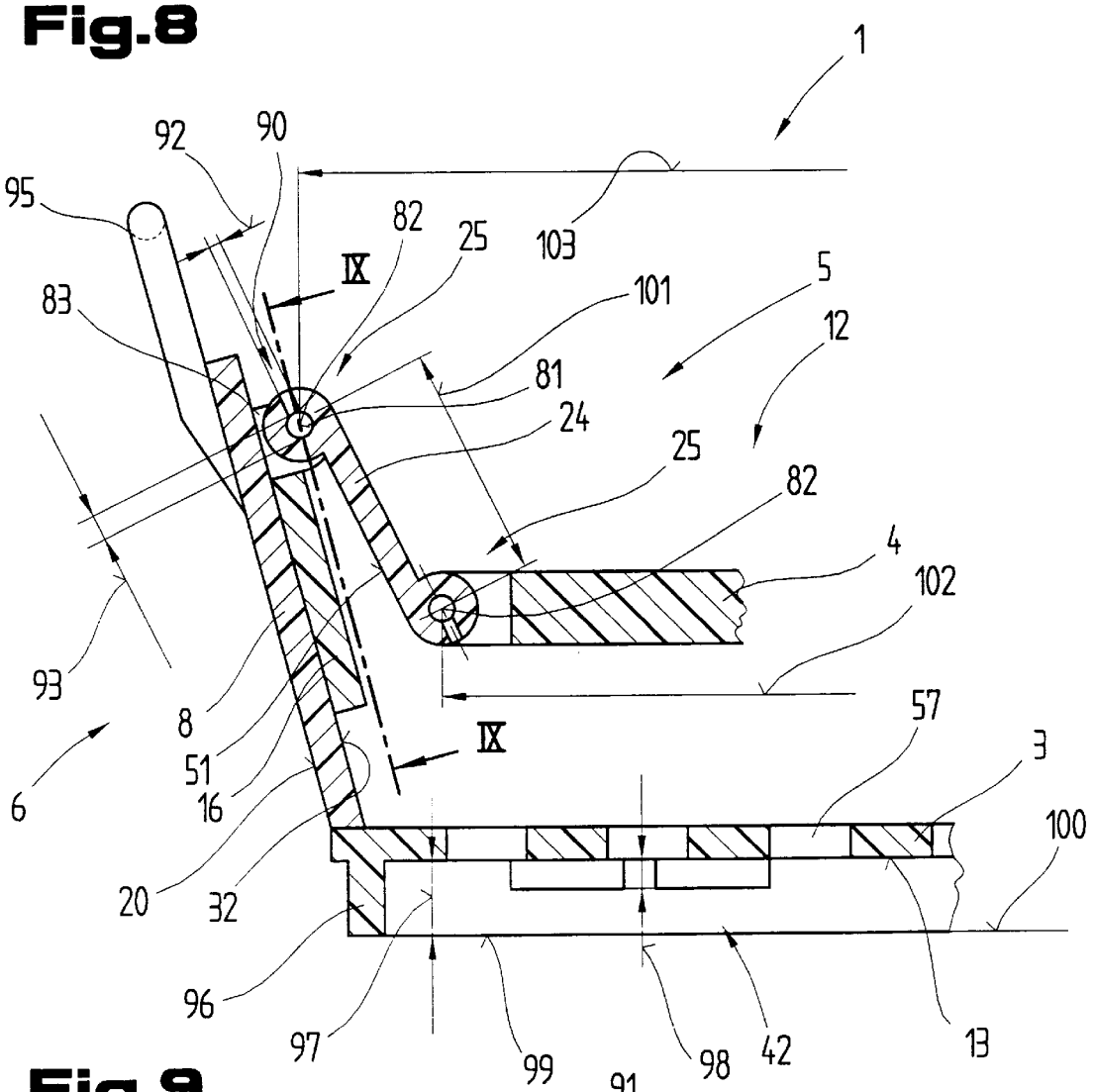
Figure 9:
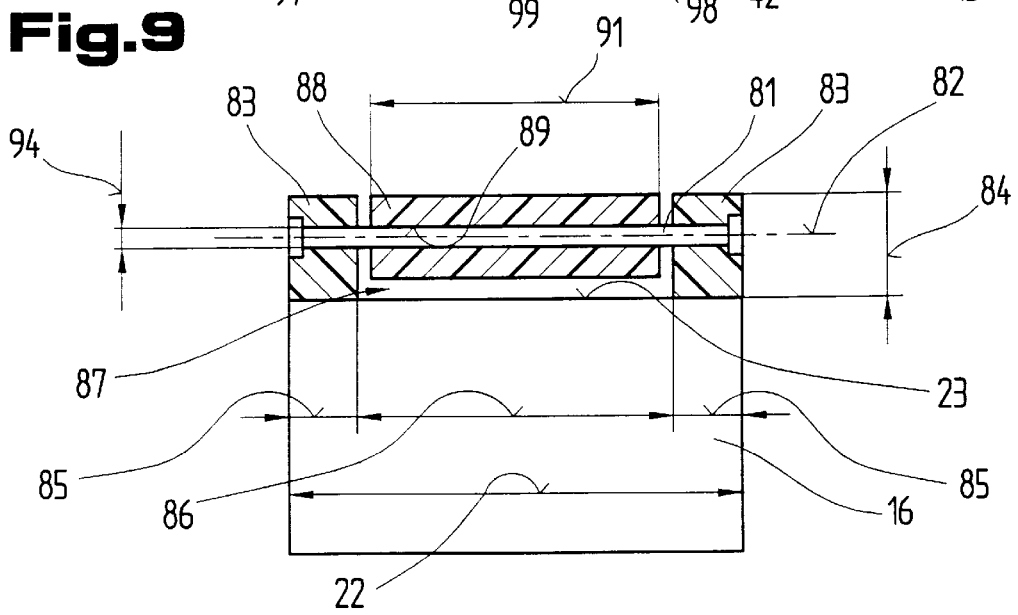
Figure 10:
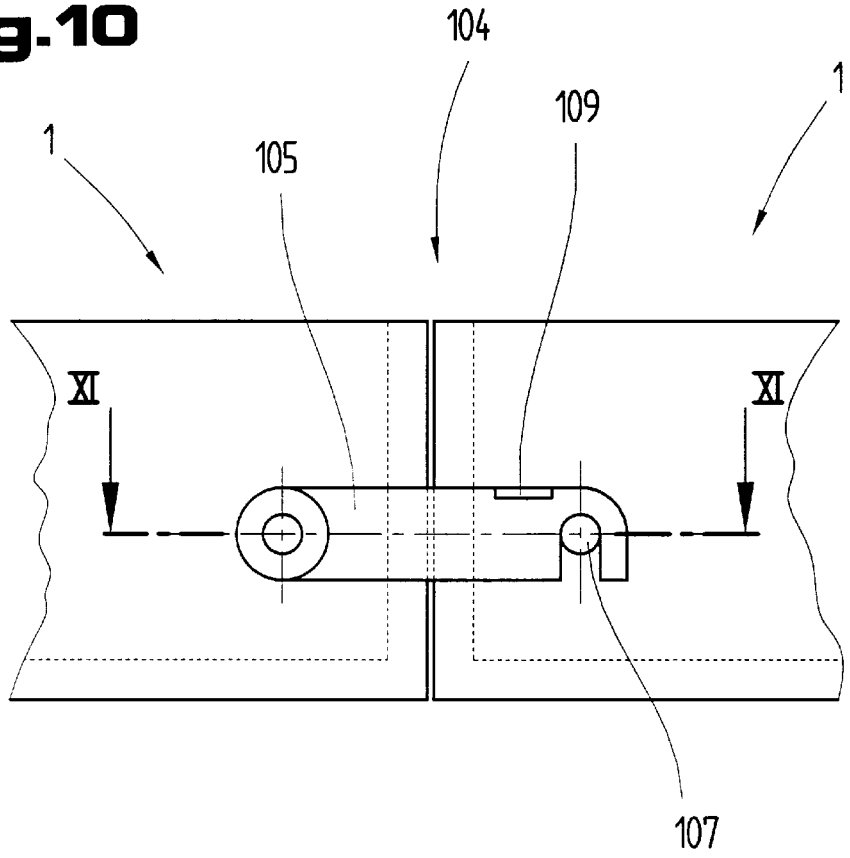
Figure 11:
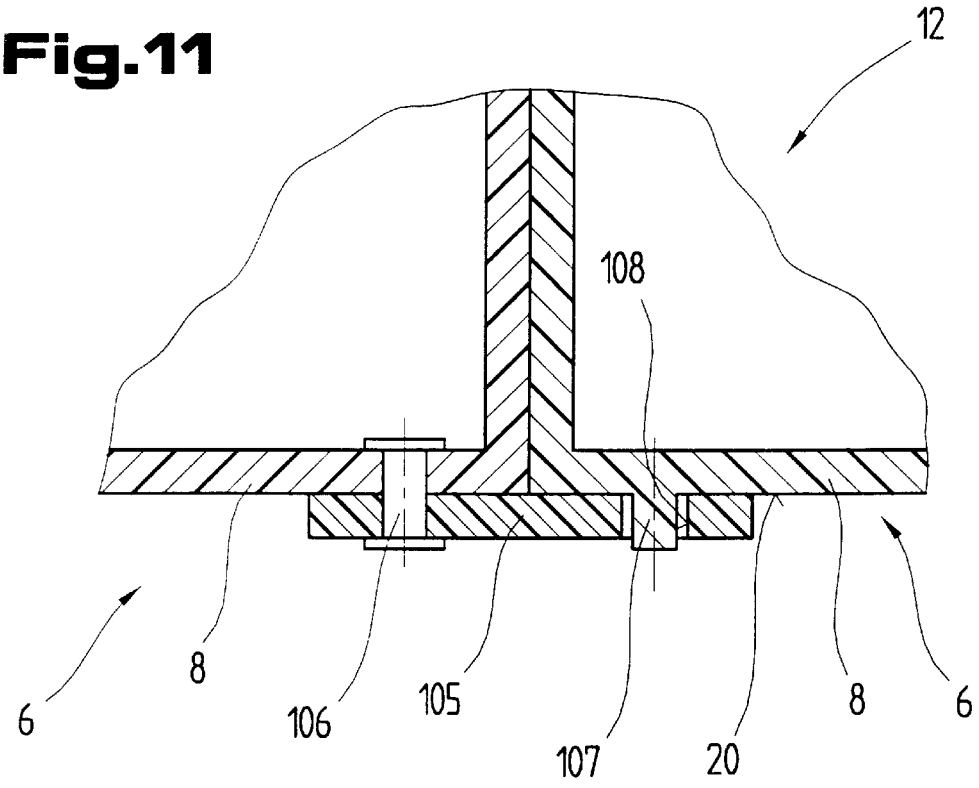
Figure 12:
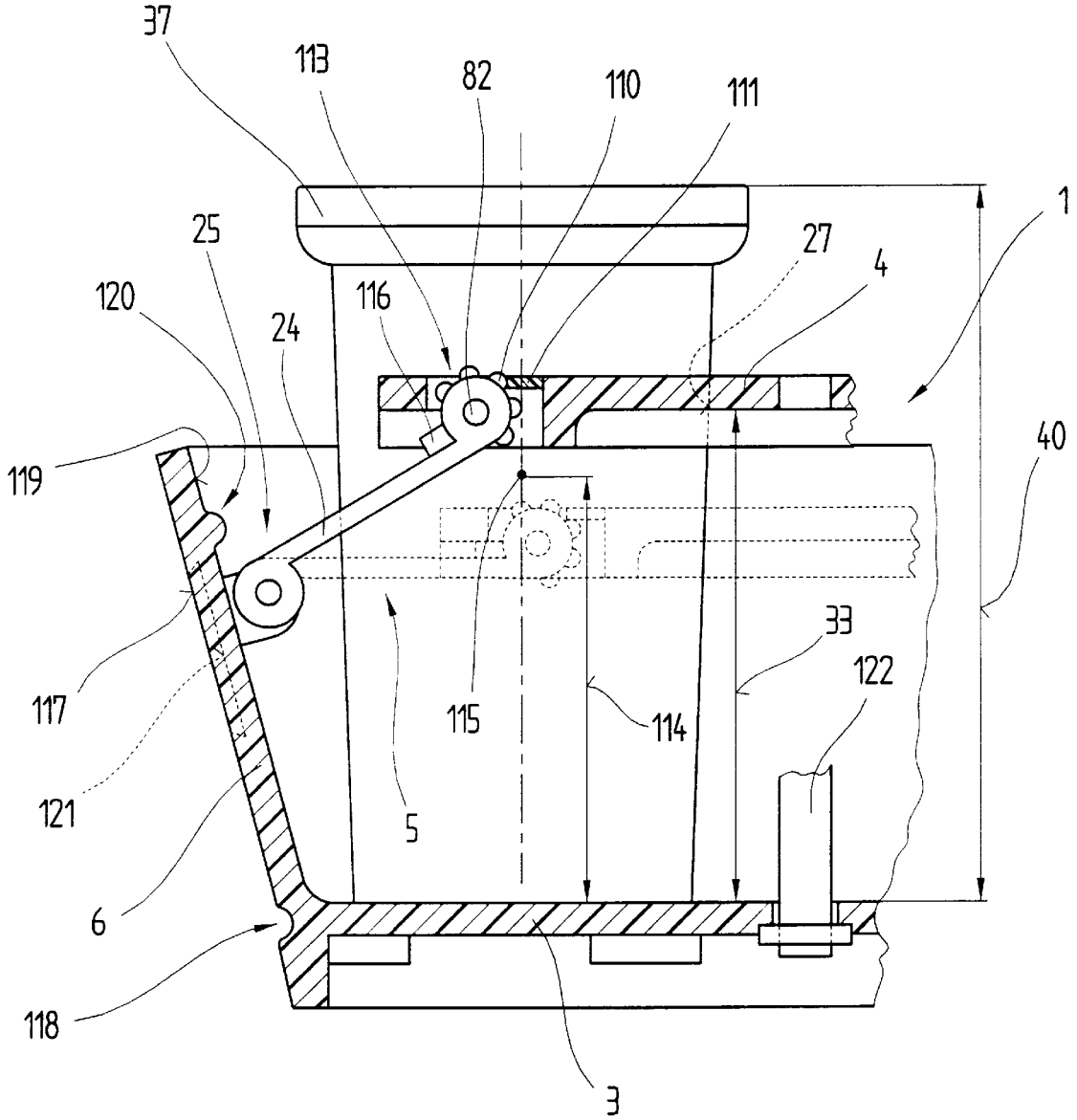

For better understanding of the invention, it will be described in more detail with reference to the embodiments given by way of example and shown in the drawings. Shown are:

FIG. 1: a perspective view of a transport and/or storage container according to the invention;

FIG. 2: two transport and/or storage containers according to the invention disposed one above the other in the transport condition, in cross-section;

FIG. 3: the transport and/or storage containers according to the invention in section along lines III—III in FIG. 2;

FIG. 4: a constructive variant of a hinge arrangement of a transport and/or storage container according to the invention, in cross-section;

FIG. 5: a further constructive variant of a hinge arrangement of a transport and/or storage container according to the invention, in cross-section;

FIG. 6: a locking device for a hinge arrangement of a transport and/or storage container according to the invention, in section, in side elevation;

FIG. 7: the locking device according to the invention, in section along lines VII—VII in FIG. 6;

FIG. 8: another constructive variant of a hinge arrangement of a transport and/or storage container according to the invention, in cross-section;

FIG. 9: the hinge arrangement according to the invention in section along lines IX—IX in FIG. 8;

FIG. 10: a connecting device for a transport and/or storage container according to the invention, in side elevation;

FIG. 11: the connecting device according to the invention in section along lines XI—XI in FIG. 10;

FIG. 12: a partial area of a further design of the transport and/or storage container according to the invention with the displaceable positioning device, in partial section.

FIG. 1 shows a transport and/or storage container 1 in perspective view. This latter comprises a carrier body 2, which comprises at least one base 3 and a positioning device 4, which is connected via hinge arrangements 5 to the carrier body 2. In the present embodiment, the carrier body 2 of the base 3 is provided with wall members 6, which form side walls 7 and end walls 8, which are disposed immobile on the base 3, particularly moulded, glued or welded thereto. The carrier body 2 is limited by a length 9 externally embracing the end walls 8 and a width 10 extending at right angles thereto, and externally embracing the side walls 7. A longitudinal axis of symmetry 11 extends parallel to the length 9 and halves the width 10. The wall members 6 and the base 3 define an inner cavity 12, the base 3 having a support surface 13 facing away therefrom.

The wall members 6 further extend for example at right angles to the base 3, and have an upper side 14, which, facing away from the support surface 13 extending parallel thereto, is spaced therefrom by a wall height 15. On the upper side 14 of the side walls 7 and/or of the end walls 8, projecting over these, are integrally moulded, glued or welded attachment tabs 16, which project over the upper side 14 in the opposite direction to the support surface 13 by the height 17 of a tab. The attachment tabs 16 are for example disposed symmetrically to the longitudinal axis of symmetry 11 and a transverse axis of symmetry 18 extending at a right angle thereto and having the length 9, a tab outer side 19 facing away from the inner cavity 12 extending flush or on a plane surface with an outer side 20, likewise facing away from the inner cavity 12, of the side walls 7.

The attachment tabs 16 are respectively spaced from one another with surfaces facing one another by the same distance 21 from the transverse axis of symmetry 18, and have a tab width 22 measured parallel to the length 9 or to the spacing 21. On the upper side 23 of a tab facing away from the upper side 14 and spaced therefrom by a tab height 17, there are disposed spacer members 24, pivotally connected to the attachment tab 16, and for example integrally moulded, glued or welded on, the transition from the attachment tab 16 to the spacer member 24 being constructed as a hinge 25, preferably in the form of a film hinge 26. The positioning device 4 located in the inner cavity 12 is plate-shaped and has apertures 27 for receiving the transport goods in the form of cans, bottles or tubs.

It is bordered by an end surface 28 extending for example parallel to the wall members 6 and at right angles to the support surface 13, said end surface 28 facing the wall members 6. Moulded, glued or welded to the end surface 28 are the spacer members 24, which likewise, in the transition to the end surface 28, are pivotally located on said end surface by a film hinge 26 preferably forming a joint 25. The plate-shaped positioning device 4 has a plate length 29 extending parallel to the length 9 and a plate width 30 extending at right angles to this. These have smaller dimensions than the corresponding length 9 or width 10 of the carrier body 2. A plate underside 31 of the positioning device 4 adjacent to the base 3 and extending parallel thereto is spaced from an inner side 32 of the base 3 facing this by a minimal spacing 33, which comes to between 5 mm and 20 mm, particularly 10 mm. As shown in broken lines, the positioning device 4 can be pivoted by the film hinges 26 into an upper position parallel to the base 3, the plate underside 31 now being spaced from the inner side 32 of the base 3 at a maximum distance 34, which comes to between 30 mm and 100 mm, preferably 60 mm.

It is however also possible to dimension the minimum space 33 and the maximum distance 34 optionally, and thus a pivotal height 35 resulting from the difference between both.

As already indicated, the carrier body 2 can be designed without side walls 7 and without end walls 8, in this case the attachment tabs 16 being located directly on the base 3 and thus fulfilling the function of the wall members 6, e.g. for stacking the transport and/or storage containers 1 one above the other, or in order to stiffen them. It is also possible to design the transport and/or storage container 1 or the base 2 in a circular or oval configuration, the hinge arrangements 5 for example being possibly attached off-set to one another at an angle of 90°. The apertures 27 in the present embodiment are circular but, depending on the cross-section of the transport goods, can have any contour shape such as oval, triangular, rectangular or polygonal.

Shown in cross-section in FIG. 2 are two transport and/or storage containers 1, disposed one above the other, as they are for example arranged during transport. Thus there are disposed in the inner cavity 12 of the lower transport and/or storage container 1 transport goods 36, such for example as tubs 37 but also bottles or cans, which stand upright on the inner side 32. These for example rotationally symmetrical transport goods 36 have axes of symmetry 38 extending in their centre, which are spaced from one another by a division 39. A height 40, extending at a right angle to the inner side 32 and parallel to the axis of symmetry 38, which defines the transport goods in their vertical extension, serves to space the upper transport and/or storage container 1 from the one lying below. The support surface 13 of the base 3 of the upper transport and/or storage container lies flush on an upper side 41 of the transport goods 36 facing away from the inner side 32 and extending parallel thereto.

In FIG. 2 however, in order to render the details more visible, a small slot has been indicated between the upper side 31 and the support surface 13. There extend from the support surface 13, opposite the inner space 12, centring projections 42 projecting over the support surface 13. The wall members 6, particularly the side walls 7, extend in the direction of the wall height 15 with respect to the inner space 12 in a conically expanded form, at an angle 43, which is defined by a planar extension of the support surface 33 and the outer side 20 and comes for example to an angle of between 30° and 80°. Located on the upper side 14 are the spacer members 24, which are connected by the joints 25 in the form of the film hinges 26 to the side walls 7. In this way the hinge arrangement 5 can be formed purely by the spacer member 24, the hinge 25 being located directly on the upper side 14. The transition of the spacer members 24 to the plate-shaped positioning device 4 is likewise in the form of film hinges 26.

If the plate-shaped positioning device 4 is at the maximum distance 34 from the inner side 32, then the transport and/or storage container 1 is in the transport condition and the transport goods 36 are centred in the transport and/or storage container 1. As shown in broken lines, the positioning device 4 can be pivoted into a position close to the base, the minimum space 33 between the plate underside 31 and the inner side 32 being defined. By means of the conically extending expansion of the wall members 6, the transport and/or storage containers 1 can also be stacked one in another in the unfilled condition, i.e. without transport goods 36, the base 3 of the transport and/or storage container 1 being placed either on the plate-shaped positioning device 4, the spacer member 24 or the wall member 6.

As will now be more clearly seen in FIG. 3, the transport goods 36 or their axes of symmetry 38 spaced by the division 39 are so located in the positioning device 4 that intermediate spaces 45 defined by the contour lines 44 of the transport goods 36 are kept as small as possible. The centring projections 46 engage in these intermediate spaces 45 in the region of the upper side 41 of the transport goods 36 in the form of tubs 37. In the present embodiment these are in the form of centring pins 46, which have curved surfaces 47 facing the transport goods 36, and which are moulded to match the contour lines 44 of the tubs 37. Pin end surfaces 48 facing one another of the centring pins 46 can be spaced apart. It is however also possible that the centring pins 46 are shaped together to form a common pin, which simultaneously spaces apart more than two pieces of transport goods 36. It is also possible to design the centring pin 46 with a circular or oval contour, this latter spacing apart the transport goods 36, particularly the tubs 37, at points of contact which lie on the enveloping surfaces surrounding the transport goods 36.

FIG. 4 shows that the film hinge 26, which connects the spacer member 24 and the attachment tab 16 at edges facing one another, for example in the form of a thickened portion of material 49, lies in an intersecting area of the inner side 32 of the wall member 6 and a surface 51 facing this and extending at an angle of inclination 50 obliquely thereto in the direction of the base 3 and of the inner space 12. This thickened portion of material 49 can be produced by a one-piece connection of the attachment tab 16 to the spacer member 24, but also by gluing or welding. In an end area 52, in which the spacer member 24 and the plate-shaped positioning device 4 abut on one another, these have undercuts 53. These are formed by end surfaces 54 facing one another which, when the positioning device 4 is at a minimum spacing 33, are inclined to one another at an opening angle 55. The intersection point of the end surfaces 54 extending towards one another at the opening angle 55 lies in that range in which the plate underside 31 of the plate-shaped positioning device 4 abuts on the surface 51 of the spacer member 54.

In this way a free space is achieved which prevents the end surfaces 54 of the positioning device 4 and of the spacer member 24 from contacting one another, so that jamming at the end surfaces 54 and a resultant tensile stress is prevented on the film hinge 26 which is located between the positioning device 4 and the spacer member 24. The design of the joint 25 or of the film hinge 26 and the avoidance of excessive tensile stress on the joint 25 can be effected in any form known to the average Expert.

An intermediate position of the plate-shaped positioning device 4 is shown in broken lines. This is adopted when the positioning device 4 is moved away from the minimum spacing 33 opposite the base 3 for purposes of loading. Thus it can be seen that the wall member 6 and/or the attachment tab 16 are resiliently deformed opposite the inner space 12, this deformation corresponding to a maximum deviation 56, at which the spacer member 24 is in a position roughly parallel to the base 3. Like the wall member 6 and/or the attachment tab 16, the plate-shaped positioning device 4 undergoes a resilient deformation which likewise reaches its maximum when the spacer member 24 is in a horizontal position. If the positioning device 4 is now moved further away from the base 3, then both the wall members 6 and/or the attachment tab 16 and the plate-shaped positioning device spring back into their original condition. Thus, in the intermediate position of the plate-shaped positioning device 4 shown in broken lines, a dead-centre point is reached at which, when it is exceeded, a beyond-dead-centre lock results, for which reason the plate-shaped positioning device 4 does not pivot automatically into the position close to the base.

In FIG. 5 the transport and/or storage container 1 is shown with an end wall 8, which has a lattice shape and has apertures 57. The side walls 7 and the base 3 can likewise be provided with such apertures 57, causing a reduction in the tare weight of the transport and/or storage container 1. As is further visible, the attachment tab 16 is located on the inner side 32 of the side wall 7, for example glued or welded, and projects over the inner side 32 in the direction of the inner space 12.

The joint 25 is in turn in the form of a film hinge 26. A point of contact 58 between the spacer member 24 and the plate-shaped positioning device 4 is formed in that the end area 52 of the spacer member 24 and of the plate-shaped positioning device 4 is provided with a prism-shaped end area 59. This is defined by two end surfaces 54 expanding from the point of contact 15 away and expanding through a prism angle 60. In this way there are produced both on the side facing the base 3 and on the side of the hinge 25 facing away therefrom, the undercuts 53, which prevent jamming of the end surfaces 54 upon pivoting of the plate-shaped positioning device 4 and thus tensile stress on the joint 25.

In FIGS. 6 and 7, described together, there is another possible arrangement of the attachment tab 16 on the inner side 32 of the wall member 6. This is detachably connected to the wall member 6 via a guide arrangement 61. The guide arrangement 61 comprises two L-shaped guide webs 63 projecting over the inner side 32 in the direction of the inner space 12, extending symmetrically by a plane of symmetry 62 extending at a right angle to the base 3. The guide webs 63 partly comprise an inner surface 64 of the attachment 16, facing the inner space 12, and which extends parallel to the inner side 32 of the wall member 6. They also comprise end sides 65 of the attachment tab 16, which extend facing away from one another parallel to one another and at a right angle to the inner surface 64. These define an inner width 66 of the attachment tab 16, measured parallel to the inner side 32, which is smaller than an inner width 68 of the guide arrangement 61, measured parallel to the inner width 66, and defined by guide surfaces 67 facing one another and extending at right angles to the inner side 32 and symmetrically to the plane of symmetry 62.

In this way a clearance 69 is provided which has roughly half the value of the difference of the inner width 68 and of the inner breadth 66. A guide surface 70 of the L-shaped guide web 63 extending parallel to the inner side 32 and facing the inner surface 64, of the L-shaped guide web 63 is thus likewise spaced apart from the inner surface 64 roughly by the clearance 69. A guide arrangement 61 so formed can however also be formed as a dovetail guide or an easy-running guide profile.

The attachment lug 16 also has, in an area located between the guide arrangement 61 and the base 3, a resilient engagement device 71, which prevents the attachment tab 16 from slipping automatically out of the guide arrangement 61. The resilient engagement device 71 is formed by resilient legs 72 located symmetrically about the plane of symmetry 62 and integrally connected, i.e. as one piece with the attachment tab 16, said resilient legs 72 being spaced apart by a recess 73 likewise extending symmetrically about the plane of symmetry 62. Located on the resilient legs 72, opposite the recess 73, is a respective engagement projection 74, which is for example connected as one piece, and which projects over the end sides 65 opposite to and at right angles to the plane of symmetry 62 by the height of an engagement projection 75. This latter is so dimensioned that it extends beyond the inner width 68 of the guide arrangement 61 defined by the guide surfaces 67 and forms a stop surface 76 extending parallel to the base 3, and facing the guide webs 63.

If an attempt is now made to move the attachment tab 16 opposite the base 3 out of the guide arrangement 61, the stop surface 76 contacts an end face 77 facing the base 3 of the guide webs 63, preventing the attachment tab 16 from sliding out of the guide arrangement 61 opposite the base 3. If however the attachment tab 16 and thus the positioning device 4 are to be moved out of the guide arrangement 61, a force is exerted on the resilient legs 72 in the direction of the plane of symmetry 62, so that these latter are deformed resiliently in the direction of the plane of symmetry 62 up to a spacing which is equal to or less than the inner width 68. The attachment tab 16 further has on its end facing the spacer member 24 projections 78 which, like the engagement projections 74, project over the end faces 65 of the guide webs 63 opposite the plane of symmetry 62.

The projections 78 have, facing the guide webs 63 and the base 3, extending for example at right angles to the plane of symmetry 62, stop surfaces 79 which face surfaces 80 of the guide webs 63 extending parallel thereto. If the attachment tab 16 is introduced into the guide arrangement 61, then the stop surfaces 79 of the projections 78 and the surfaces 80 of the guide webs 63 are in a position contacting one another. Due to the design of the projections 78, the attachment tab 16 or the stop surfaces 79 can be introduced only as far as the surfaces 80 of the guide webs 63 into the guide arrangement 61. Due to the design of the attachment tab 16 with the resilient projections 74 the attachment tab 16 is prevented from being accidentally moved out of the guide arrangement 61. The resilient engagement device 71 can however be designed in any way evident to the average Expert.

FIGS. 8 and 9 show a further constructive variant of the transport and/or storage container 1, particularly of the hinge arrangement 5. This latter in turn has the attachment tab 16, which is located on the inner side 32 of a wall member 66, for example the end wall 8, projecting this latter in the direction of the inner space 12. It can be located immobile on the inner side 32 by gluing or welding. The attachment tab 16 has on its end facing away from the base 3 the joint 25, by means of which the spacer member 24 is articulated to be rotarily movable. The joint 25 is formed by a cylindrically shaped bearing bolt 81, which is mounted in a rotationally symmetrical manner about a bearing axis 82, which extends in the centre of the bearing bolt 81. It is also for example made of metal and located immobile in bearing blocks 83. These are preferably integrally connected to the attachment tab 16, and are in particular moulded, glued or welded thereto, and project over the tab upper side 23 extending parallel to the base, by the height of the bearing block 84.

At a right angle to the height of the bearing block 84, the bearing block 83 is delimited by a bearing block width 85 measured parallel to the upper side of the tab 23, the difference between the tab width 22 and the sum of the two bearing block widths 85 giving a bearing width 86. Within a bearing area 87 comprising the bearing width 86 and the bearing block height 84, there is a counter-bearing 88, which is integrally connected or glued or welded to the spacer member 24. This latter has a bearing housing 89, in the form for example of a bore disposed symmetrically about the bearing axis 82, and which surrounds the surface of the bearing bolt 81 with the exception of a slot-shaped opening 90. The slot-shaped opening 90 extends over a counter-bearing length 91 measured parallel to the bearing width 86 and externally surrounding the counter-bearing 88. If the spacer member 24 is now in rotarily movable engagement via the bearing housing 89 with the bearing bolt 81, the slot-shaped opening 90 has a slot width 92 which is greater than if the bearing bolt 81 were not disposed in the bearing housing 89. This means that a bore diameter 93 for receiving the bearing bolt 81 is smaller than a bolt diameter 94. If now the spacer member 24 is to be brought into rotarily movable engagement with the attachment tab 16, the slot-shaped opening 90 or its slot width 92 is expanded to the measure of the bolt diameter 94, and the bearing bolt 81 is introduced into the slot-shaped opening 90. Upon reaching the bearing housing 89, the slot-shaped opening 90 springs back and in common with the bearing housing 89 exerts a bias force on the bearing bolt 81. In this way the bearing bolt 81 is prevented from independently slipping out of the counter bearing 88 of the spacing member 24. Such a design can also be formed at the joint 25 between the spacing member 24 and the plate-shaped positioning device 4.

It is also possible to form on the bearing blocks 83, symmetrically about the bearing axis 82, bearing bolts 81 facing one another, which can in turn be brought into rotarily movable engagement in a bearing housing 89. The bearing bolt 81 may also be rigidly connected to the counter bearing 88 and brought into rotary engagement in bearing housings 89 of the bearing blocks 83. In this variant the slot-shaped opening 90 would then be disposed in the bearing blocks 83.

As may further be seen, there may be disposed on the outer side 20 of the wall member 6, for example of the end wall 8, a handle 95, which can be disposed both integrally with the wall member 6 for example by moulding, welding or gluing, but also in a rotarily movable manner or by means of a detachable connecting device. The handle 95 can however also be formed by apertures in the wall member 6. The base 3 has apertures 57, by means of which the tare weight of the transport and/or storage container is minimised. Moulded, glued or welded onto the support surface 13 are reinforcing ribs, which project over these by a rib height 97 opposite the inner space 12. This height is preferably greater than a projection height 98 measured at right angles to the support surface 13, of the centring projections 42. The reinforcing ribs 96 form a bearing surface 99 extending parallel to the base 3, by means of which the transport and/or storage container 1 is set on a support surface. This design prevents the transport and/or storage container from being set down on the centring projections 42, which could give rise to undefined intermediate positions of the transport and/or storage container 1.

In addition, as already described, a beyond-dead-centre lock of the plate-shaped positioning device is achieved in its position remote from the base 3, as the sum of two distances 101 respectively extending parallel to the surface 51 and spacing the two bearing axes 82 of the spacing member 24, and a spacing 102 extending parallel to the plate-shaped positioning device 4, spacing its bearing axis 82, is greater than a width 103 parallel to the base 3, spacing the two bearing axes 82 of the attachment tabs 16 lying opposite one another. If now the plate-shaped positioning device 4 is moved from the lower position into the upper position, the wall members 6 undergo a resilient deformation opposed to the inner space 12. This is at its greatest when the bearing axis 82 of the hinge 25 disposed between the attachment tab 16 and the spacer member 24 and the bearing axis 82 of the joint 25 disposed between the positioning device 4 and the spacer member 24 lie in a plane parallel to the base 3.

Finally, in FIGS. 10 and 11, which are described together, there is illustrated a connecting device 104, which connects two adjacent transport and/or storage containers together. In this way, particularly during transport, transport and/or storage containers 1 aligned above one another and next to one another are prevented from slipping; in this way a compact transport unit is provided. The connecting device 104 is formed by a connecting bracket 105, which is disposed via a rotary bolt 106 on wall members 6, for example on the end wall 8, and a connecting pin 107 which is disposed for example on the end wall 8 of the adjacently disposed transport and/or storage container 1. The connecting pin 107 is integrally connected as one piece with the wall member 6, and is for example moulded, glued or welded thereon, and projects above the outer side 20 in the opposite direction to the inner space 12. Further, it is for example cylindrical in shape and surrounded at areas by a connecting slot 108. This latter is disposed in the connecting bracket 105. The connecting bracket 105 may also be provided with a handle member 109, by means of which it is simple to actuate the connecting device 104.

The connecting device 104 may also however be formed by a linearly movable connecting bracket 105 and/or may be located in the inner space 12.

FIG. 12 shows a further design of the hinge arrangement 5. The spacer member 24 is mounted on the wall member 6 of the transport and/or storage container 1 to pivot via the hinge 25. A further bearing point serves as a support for the spacing member 24 via the bearing axis 82 on the positioning device 4 provided with apertures 27. The spacing member 24 is provided in the area of the bearing axis 82 on its outer contour extending concentric with the bearing axis 82, with resilient engagement projections 110. A locking element 111 resiliently connected to the positioning device 4 projects into the area of the resilient engagement projections 110. The resilient connection projections 110 form in conjunction with the locking member 111 a resilient engagement device 112 for the positioning device 4, the locking member 111 engaging in interspaces 113 between the resilient engagement projections 110. Thus, in addition to the beyond-dead-centre lock already described, a raised position of the positioning device 4 relative to the base 3 of the transport and/or storage container 1 is possible at predetermined spacings.

For transport of the transport and/or storage container 1 filled with the goods, e.g. tubs, cans, etc., normally a position of the positioning device 4 is selected at a spacing 33 from the base 3 which is greater than a height 114 of a centre of gravity 115, e.g. of the tub 37. If now the transport and/or storage container 1 is placed in a storage rack, the positioning device 4 may be displaced into a position close to the base, as shown in broken lines, so that it is simpler to remove the tubs 37. Despite this, the tubs 37 remain fixed in their position; with such a design, the transport and/or storage container 1 may also for example be stored in an inclined rack container.

A design is also possible in which, in addition to the resilient engagement projections 110, there are disposed on the spacer member 24 stop members 116, by means of which for example an uppermost and lowermost position of the positioning device 4 is established.

The design of the resilient engagement device 112 may be such that the positioning device 4 may be lowered as a consequence of the spring effect out of its uppermost position when loaded by the tubs 37, i.e. when these have a smaller constructive height and are secured in the aperture 27 due to the conicity, without being supported on the base 3, and the resilient engagement device 12 comes into effect for setting further lower positions only after this lowering procedure.

Instead of the design of the hinges 25 with the bearing axes 82 formed by a bearing bolt 81, so-called hammer hinges are also possible, in which the bearing axis 82 is formed by cylindrical projections forming an outstanding collar from the spacer member 28 at opposed side surfaces.

As may further be seen in FIG. 12, the wall member 6 may have on an outer surface 117 roughly in the area of the base 3 a groove-shaped recess 118, which extends roughly parallel to the base 3 and which, when empty transport and/or storage containers are stacked in one another, co-operate with bead-shaped raised portions 120 diametrically opposed on an inner surface 119, and form a latch for the transport and/or storage containers stacked in one another.

Naturally, the wall members 6 and/or the base 3 may be provided, for purposes of saving material or for ventilation, with large-area apertures, and in addition may have receiving means for insertable labels or recesses 121 for receiving packing strips.

For transport and/or storage containers stacked on one another, the arrangement is also possible of known centring spikes 122 extending vertically through the stack which for example have bayonet closures and in the locked condition secure a stack of a predetermined number of transport and/or storage containers 1. Such centring spikes 122 are normally designed also to receive a predetermined number of transport and/or storage containers and thus also fulfil the function of a counting spike.

The transport and/or storage container 1 has been shown out of scale in the Figures in order to make the constructive details more visible. It is also possible to combine all the constructive details together. Naturally it is also possible that individual features or combinations of features quoted in the sub-claims or in the description, can form independent inventions.

List Of Reference Numbers 1. transport and/or storage containers 2. carrier body 3. base 4. positioning device 5. hinge arrangement 6. wall member 7. side wall 8. end wall 9. length 10. width 11. longitudinal axis of symmetry 12. inner space 13. support surface 14. upper side 15. wall height 16. attachment tab 17. tab height 18. transverse axis of symmetry 19. tab outer side 20. outer side 21. spacing 22. tab width 23. tab upper side 24. spacer member 25. hinge 26. film hinge 27. aperture 28. end surface 29. plate length 30. plate width 31. plate underside 32. inner side 33. spacing 34. distance 35. pivotal height 36. transport material 37. tub 38. axis of symmetry 39. division 40. height 41. upper side 42. centring projection 43. angle 44. contour line 45. interspace 46. centring pin 47. curved surface 48. pin end surface 49. material thickening 50. angle of inclination 51. surface 52. end area 53. undercut 54. end surface 55. opening angle 56. deviation 57. aperture 58. contact point 59. end area 60. prism angle 61. guide arrangement 62. plane of symmetry 63. guide web 64. inner surface 65. end side 66. inner width 67. guide surface 68. inner width 69. clearance 70. guide surface 71. resilient engagement device 72. spring leg 73. recess 74. resilient engagement projection 75. height of resilient engagement projection 76. stop surface 77. end surface 78. projection 79. stop surface 80. surface 81. bearing bolt 82. bearing axis 83. bearing block 84. bearing block height 85. bearing block width 86. bearing width 87. bearing area 88. counter bearing 89. bearing housing 90. opening 91. counter bearing length 92. slot width 93. bore diameter 94. bolt diameter 95. handle 96. reinforcing rib 97. rib height 98. projection height 99. bearing surface 100. supporting surface 101. distance 102. spacing 103. width 104. connecting device 105. connecting bracket 106. rotary bolt 107. connecting pin 108. connecting slot 109. handle member 110. resilient engagement projection 111. locking member 112. resilient engagement device 113. interspace 114. height 115. centre of gravity 116. stop member 117. outer surface 118. recess 119. inner surface 120. raised portion 121. recess 122. centring spike

I claim:

1. A transport container for transporting goods, comprising:

a carrier body having a base which forms a support surface for the transport goods; and a plate-shaped positioning device extending parallel to the base and defining apertures adapted to receive the transport goods, the positioning device being connected by hinge arrangements to the base such that the positioning device is spaced from the base by a spacing distance, and the hinge arrangements being operable to move the positioning device in a direction perpendicular to the base whereby the positioning device is locatable in a plurality of positions having different spacing distances from the base.

2. A transport container according to claim 1, the base further including a plurality of wall members upstanding from a support surface of the base, the support surface and the wall members defining an inner space within the base, and the positioning device being disposed in the inner space.

3. A transport container according to claim 2, wherein the hinge arrangements have spacer members which are formed by strip-shaped projections, and are integrally connected to the positioning device.

4. A transport container according to claim 3, wherein the hinge arrangements have attachment tabs connecting the spacer members to the base.

5. A transport container according to claim 4, wherein the attachment tabs (16) are connected in an immobile manner to the base.

6. A transport container according to claim 4, further comprising guide arrangements for the attachment tabs of the hinge arrangements, the guide arrangements being attached to the wall members and facing the inner space.

7. A transport container according to claim 6, wherein the positioning device is held by engagement of the attachment tabs in the guide arrangements, and wherein each attachment tab is secured in the respective guide arrangement by a resilient engagement device.

8. A transport container according to claim 4, wherein each spacer member is flexibly connected to at least one of the positioning device and the respective attachment tab.

9. A transport container according to claim 4, wherein the attachment tabs (16) are flexibly connected to the base.

10. A transport container according to claim 4, wherein each hinge arrangement includes a film hinge formed between the spacer member and at least one of the attachment tab and the positioning device.

11. A transport container according to claim 4, wherein each hinge arrangement includes at least one hinge formed by a bearing bolt which is centrally disposed in a bearing housing, and wherein the bearing housing forms a portion of one of the spacer member and the attachment tab and the positioning device.

12. A transport container according to claim 11, wherein the bearing housing has a slot-shaped opening which in an undeformed state of the bearing housing defines a diameter which is less than a bolt diameter of the bearing bolt and wherein the bearing housing is deformable into a deformed state expanding the slot-shaped opening such that the bearing housing exerts a clamping force on the bearing bolt.

13. A transport container according to claim 1, wherein the hinge arrangements are operable to space the positioning device from the base by a minimum spacing distance between about 5 mm and 20 mm.

14. A transport container according to claim 1, wherein the hinge arrangements are operable to space the positioning device from the base by a maximum spacing distance between about 30 mm and 100 mm.

15. A transport container according to claim 2, further comprising centering projections formed on a side of the support surface which faces away from the inner space.

16. A transport container according to claim 2, wherein at least one of the base and the wall members is formed in a lattice shape.

17. A transport container according to claim 2, wherein the wall members diverge conically with respect to the inner space in the direction of a wall height.

18. A transport container according to claim 4, wherein each of two opposite sides of the positioning device is attached to at least one attachment tab by at least one spacer member, each spacer member being hingedly attached by a first hinge to the respective attachment tab and by a second hinge to the positioning device, the first and second hinges respectively defining first and second bearing axes spaced apart by a length in a direction parallel to the spacer member, the first bearing axes of the first hinges located on the opposite sides of the positioning device defining a first width therebetween, and the second bearing axes of the second hinges located on the opposite sides of the positioning device defining a second width therebetween, and wherein the first width is less than the sum of the second width and the length.

19. A transport container according to claim 4, wherein at least one of the spacer members includes at least one resilient engagement device adapted to resiliently engage at least one of the attachment tab and the positioning device such that the positioning device is held in a selected one of said plurality of positions.

20. A transport container according to claim 4, wherein a resilient engagement device is formed by resilient engagement projections disposed on the spacer member, and locking members resiliently connected to the positioning device and projecting into the path of movement of the resilient engagement projections.

21. A transport container according to claim 4, wherein at least one of the hinge arrangements of the spacer member includes a stop member operable to limit the pivotal range of movement of the spacer member, the stop member being mounted on one of the spacer member and the positioning device and the wall members.

22. A transport container according to claim 2, wherein at least two of the wall members lying opposite one another have coupling devices formed by recesses and by raised portions for detachable connection of transport containers stacked one in the other.

23. A transport container according to claim 2, wherein recesses are formed in areas of outer surfaces of the wall members for receiving labels.

24. A transport container according to claim 2, wherein the spacing distance of the positioning device from the base in a maximum spacing position of the positioning device is greater than a height of a centre of gravity of the goods contained in the transport container.

25. A transport container according to claim 2, wherein a range of adjustment of the positioning device measured in a vertical direction to the base, between an upper and a lower end position, roughly corresponds to half the height of the goods contained in the transport container.

* * * * *